US009127410B2

(12) United States Patent
Carels

(10) Patent No.: US 9,127,410 B2
(45) Date of Patent: Sep. 8, 2015

(54) ELASTIC PAD FOR CONCRETE ELEMENTS ON WHICH RAILS OF A RAILWAY REST

(75) Inventor: Patrick Carels, Overijse (BE)

(73) Assignee: PANDROL CDM TRACK N.V., Hoeilaart (BE)

( * ) Notice: Subject to any disclaimer, the term of this patent is extended or adjusted under 35 U.S.C. 154(b) by 147 days.

(21) Appl. No.: 13/876,121

(22) PCT Filed: Sep. 27, 2011

(86) PCT No.: PCT/BE2011/000057

§ 371 (c)(1),
(2), (4) Date: Mar. 26, 2013

(87) PCT Pub. No.: WO2012/040798

PCT Pub. Date: Apr. 5, 2012

(65) Prior Publication Data

US 2013/0193222 A1 Aug. 1, 2013

(30) Foreign Application Priority Data

Sep. 27, 2010 (BE) ..... 2010/0574

(51) Int. Cl.
*E01B 3/46* (2006.01)
*E01B 3/36* (2006.01)

(52) U.S. Cl.
CPC .... *E01B 3/36* (2013.01); *E01B 3/46* (2013.01)

(58) Field of Classification Search
CPC ..... E01B 1/00; E01B 19/00; E01B 31/00; E01B 31/20; E01B 31/26
USPC ..... 238/29, 30, 83, 105, 382
See application file for complete search history.

(56) References Cited

FOREIGN PATENT DOCUMENTS

| | | | | |
|---|---|---|---|---|
| EP | 1186709 | | 3/2002 | |
| FR | 2935399 | | 3/2010 | |
| WO | WO 2008/122066 | | 10/2008 | |
| WO | 2009108972 | * | 9/2009 | ..... E01B 19/00 |
| WO | WO 2009/108972 | | 9/2009 | |
| WO | WO 2009108972 | * | 9/2009 | ..... E01B 19/00 |

OTHER PUBLICATIONS

International Search Report and Written Opinion of International Searching Authority, dated Feb. 28, 2012.

* cited by examiner

*Primary Examiner* — R. J. McCarry, Jr.
(74) *Attorney, Agent, or Firm* — Dority & Manning, P.A.

(57) ABSTRACT

Elastic pad with a concrete element on which rails of a railway rest, whereby the elastic pad includes a fixing mat and an elastic mat, the fixing mat being provided with standing filaments that are at least partially embedded in the concrete element.

21 Claims, 1 Drawing Sheet

ELASTIC PAD FOR CONCRETE ELEMENTS ON WHICH RAILS OF A RAILWAY REST

The invention concerns an elastic sole with a concrete element on which rails of a railway rest, in particular a sleeper, whereby this elastic sole comprises a tack mat and an elastic mat which are fixed to one another. On a side turned away from the elastic mat, said tack mat is provided with standing filaments which are at least partly embedded in the concrete element so as to anchor the elastic sole to the concrete element.

Further, the invention also concerns a method for fixing said elastic sole to the concrete element via the tack mat by means of the standing filaments.

Said elastic soles are put between the sleepers and the ballast bed and they are used to dampen vibrations from the rails and the sleepers towards the underlying railway bed to thus avoid any damage to the ballast bed, for example. The elastic soles must hereby resist relatively high horizontal shear stresses.

According to the present state of the art, such elastic soles are fixed to the concrete elements by embedding said soles at least partly in the concrete.

European patent EP1186709B1 describes, for example, an elastic sole which is provided with standing parts in the shape of a harpoon. These parts are embedded in the bottom side of the concrete sleeper. These standing parts are disadvantageous in that they penetrate rather deeply in the concrete and as a result have a negative effect for example on the strength of the concrete sleepers.

European patent EP1298252B1 describes a method for connecting a concrete sleeper to a railway bed by means of an elastic mat whereby this elastic mat is fixed to the concrete by means of geotextile. To this end, the geotextile is embedded in the wet concrete of the concrete sleeper on the one hand, and either embedded in the elastic mat or welded to the latter on the other hand. Said geotextile is disadvantageous, however, in that its fibres come loose from one another due to shear stresses, as a result of which the sleeper comes loose from the elastic mat.

International patent application WO2009/108972A1 describes a method whereby an elastic sole with a reinforcement layer is fixed to a concrete sleeper by means of a fibrous adhesive layer. This adhesive layer is disadvantageous as well, however, in that its fibres come loose from one another due to shear stresses, as a result of which the sleeper comes loose from the elastic mat.

French patent FR2935399 describes an elastic sole formed of an elastic mat with embedded wires forming loops for fixing the sole to a concrete sleeper. These loops are disadvantageous as well, however, in that they can come loose from one another due to shear stresses. Moreover, the loops penetrate rather deeply in the concrete sleepers, which may have a negative effect on the strength of the latter.

Further, it is also difficult to fix such existing elastic soles in the concrete if the concrete is too dry or if chippings are present in the concrete.

The invention aims to remedy these disadvantages by suggesting an elastic sole and a method making it possible to provide the bottom side of a concrete element, in particular a sleeper, in a simple manner with an elastic sole.

Moreover, the proposed solution makes it possible to fix the elastic sole in such a way that it will resist much higher shearing forces than the present solutions without compromising the strength of the concrete element.

To this aim, the tack mat has a base with a structure onto which the standing filaments are fixed, such that the base connects the standing filaments to one another as claimed in the attached claims.

Further, the base is preferably situated between the concrete element and the elastic mat and hereby fits onto the concrete element and the elastic mat. This base preferably also extends over practically the entire elastic mat.

Practically, the standing filaments extend in the concrete element up to a depth of maximally 2 mm and they are preferably homogenously distributed over the surface of the base.

In an advantageous manner, the tack mat comprises at least 25 of said standing filaments per $cm^2$, preferably at least 50 per $cm^2$, in particular at least 100 per $cm^2$.

In an advantageous manner, 10% to 90% of the surface of the tack mat is provided with standing filaments, in particular 20% to 80% of the surface, and preferably 40% to 60% of the surface.

In an advantageous manner, the standing filaments have a diameter situated between 0.05 and 2.5 mm, in particular between 0.1 and 2 mm, and preferably between 0.1 and 1 mm, and the standing filaments extend in the concrete element up to a depth of 0.1 to 10 mm, in particular 0.2 to 5 mm, and preferably 0.2 to 2 mm.

In a very advantageous manner, the tack mat is fixed to the elastic mat as the base is at least partly embedded in the elastic mat or as the base is glued or welded onto the elastic mat.

In an advantageous manner, the standing filaments are monofilaments. Further, the standing filaments preferably have the shape of a mushroom, a loop and/or a hook.

The invention also concerns a method for fixing an elastic sole to a concrete element which serves as a support for a rail in a railway.

Other particularities and advantages of the invention will become clear from the following description of practical embodiments of the method and device of the invention; this description is given as an example only and does not limit the scope of the claimed protection in any way; the following figures of reference refer to the accompanying drawings.

Figure 1:
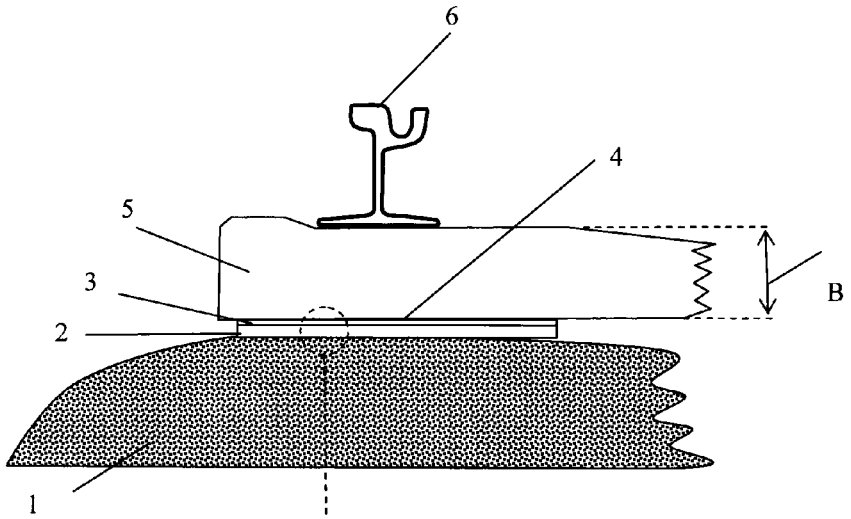
FIG. 1 is a schematic representation of a cross section of an elastic sole with a concrete element according to an embodiment of the invention.

The invention generally concerns an elastic sole for a concrete element 5 on which the rails 6 of a railway rest, in particular a sleeper, as is schematically represented in FIG. 1. This elastic sole is situated in a railway between the concrete element 5 and the ballast 1 of the railway bed. Further, the invention also concerns a method for fixing this elastic sole to the bottom side of the concrete element 5.

The elastic sole according to the invention comprises an elastic mat 2 which is provided with a tack mat 3 for fixing the elastic mat 2 to the concrete element 5. The tack mat 3 is fixed to the elastic mat 2, for example by means of gluing, and is at least partly embedded in the concrete element 5.

Figure 2:
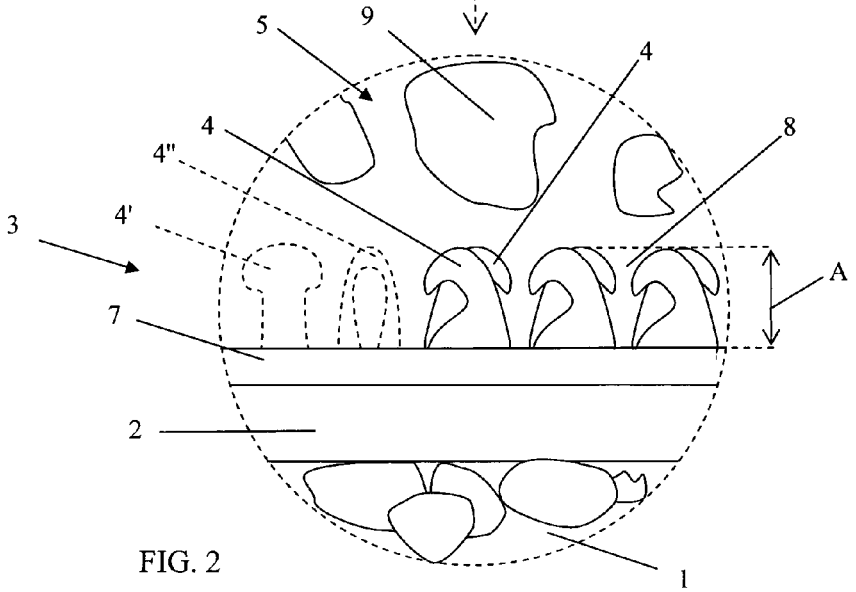
FIG. 2 is a schematic representation of a detail from FIG. 1 with standing hook-shaped filaments and whereby, as an alternative, a mushroom-shaped and a loop-shaped filament are represented.

The concrete element 5 and the tack mat 3 are put together according to the method of the invention while the concrete of the concrete element 5 is still wet and has not cured yet. The tack mat 3 has a surface with a three-dimensional structure which penetrates in the wet concrete. This structure may consist of a woven material and/or extruded material and has a base 7 with standing filaments 4, 4', 4" extending in the concrete as represented in FIG. 2. After the concrete has dried and cured, the tack mat 3 will be at least partly embedded in the concrete element 5 as a result thereof. The tack mat 3 hereby merely extends in a thin layer of concrete 8 up to a certain depth A. Thus, the tack mat 3 only extends in what is called the thin concrete milk layer, as a result of which it has no negative effect on the rigidity of the concrete element 5. Further, any chippings 9 present in the concrete will not hinder the anchoring of the tack mat.

As the filaments 4 are fixed to the base 7, and thanks to a sufficient density of the filaments 4 and an adapted shape, they provide for a very good and solid anchoring of the elastic sole.

Preferably, 10% to 90% of the surface of the tack mat 3 is formed of standing filaments 4, in particular 20% to 80%, and preferably 40% to 60% of the surface of the tack mat 3. Further, the filaments 4 are preferably homogenously distributed over this surface.

The concrete element 5 may for example be formed of a sleeper having a height B on the place where the rails rest on the sleeper, whereby this height B amounts to some 175 mm to 230 mm. Further, said sleeper may have a width of for example some 200 mm to 300 mm and a length of some 2500 mm.

With this sleeper, the standing filaments 4 of the tack mat 3 extend in the concrete element 5 up to a depth A which amounts to maximally 5% of the height B of the concrete element, in particular maximally 1%, preferably maximally 0.5%.

Further, the standing filaments 4 hereby have a diameter which amounts to maximally 1% of the height B of the concrete element 5, in particular maximally 0.5%, preferably maximally 0.1%.

Advantageously, the filaments 4 have a diameter which amounts to some 10% to 60%, preferably 20% to 50% of the length of the filaments 4.

A possible practical first embodiment of the tack mat 3 consists of a woven structure forming a base 7 with standing filaments 4.

The base 7 is glued onto an elastic mat with means known as such. The standing filaments 4 are hereby situated on the side of the base 7 turned away from the elastic mat 2 and thus remain free.

The standing filaments 4 form loops which are fixed in the woven structure of the base 7. The height of these loops in relation to the base 7 amounts to 0.2 to 4.0 mm. The loops can be made for example of nylon, polyester, polypropylene, stainless steel or polyphenylene sulphide. According to this embodiment, some 8 to 12 loops per $cm^2$ base are provided, and the section of the filament 4 forming these loops is some 0.1 to 0.2 mm. According to a variant of this embodiment, a filament density of at least 25 to 50 loops per $cm^2$ is provided for increased rigidity and better anchoring in the concrete element 5. According to yet another variant, a density of at least 500 to 1000 loops per $cm^2$ is provided.

If the base 7 fits closely onto the concrete element 5, the standing filaments 4 extend in the concrete element 5 up to a depth which amounts to maximally 0.2 to 4.0 mm, preferably up to a depth of maximally only 2.0 mm. Thus, the base 7 is situated between the concrete element 5 and the elastic mat 2.

The elastic mat 2 is formed of materials known as such and used by the expert for such elastic soles provided on the bottom side of a sleeper. These materials are made for example of resin-bound recycled rubber granules.

According to a second embodiment, the tack mat is formed of a woven base with standing filaments which are permanently fixed in the base. The standing filaments have a hook on their free ends. These hook-shaped filaments are anchored up to a depth of 0.2 to 5.0 mm in the concrete element, such that the woven base fits closely to said concrete element. The height of the standing filaments in relation to the base is 0.2 to 5.0 mm here.

According to a third embodiment, the tack mat is formed of an extruded material with standing filaments which are anchored up to a depth of 0.2 to 1.0 mm in the concrete element. Thus, the tack mat may be formed of a synthetic foil provided with standing filaments.

According to this embodiment, the tack mat has a filament density of some 50 to 100, preferably some 80 standing filaments per $cm^2$.

These standing filaments can be provided with one or several barbs and they have a cross section whose diameter amounts to 0.05 to 1.2 mm and, preferably, 0.1 to 0.8 mm.

According to a fourth embodiment, the tack mat is formed of a first woven structure forming the base with standing filaments woven therein. The far ends of these standing filaments are further interwoven with a second woven structure. The tack mat is thus formed of a first and a second woven structure, connected to one another or interwoven by means of standing filaments. Thus, the base and the standing filaments of the tack mat form a three-dimensional woven structure.

The standing filaments are at least partly embedded in the concrete element together with the second woven structure, such that the first woven structure fits tightly to the concrete element. The elastic mat is welded or glued onto this first woven structure.

According to a fifth embodiment, the tack mat comprises a woven structure with warp and weft threads onto which the standing filaments are fixed. These standing filaments comprise pile threads which are woven and/or knotted onto the warp threads and/or weft threads.

As the pile threads are not sheared or cut, they form standing loops. The loops have a height of 0.1 to 6.0 mm in relation to the warp and weft threads, preferably this height amounts to some 0.2 to 4.0 mm, ideally 0.2 to maximally 2.0 mm.

According to a variant of this embodiment, it is possible to shear the loops of the pile threads, such that the standing filaments are formed of standing threads. These pile threads can be possibly provided with barbs.

According to a sixth embodiment, the tack mat is formed of a layer of what is called a hook-and-loop strip, of a type which is known for example under the commercial name "Velcro". This hook-and-loop strip is formed of a first layer of textile with hooks and a second layer of textile with loops.

According to a first variant of the sixth embodiment, the tack mat is formed of said first layer of textile with hooks.

According to a second variant of the sixth embodiment, the tack mat is formed of said second layer of textile with loops.

This first and/or second layer of textile with hooks and/or loops is glued on an elastic mat, such that the standing hooks and/or loops remain free. The connection to the concrete element is made by embedding these hooks or loops in the wet concrete and by making this concrete cure.

The layer of textile fits closely onto the concrete element, whereby the hook and/or loop preferably merely extend in an outer layer of the concrete element whose thickness amounts to 0.2 to 5.0 mm, preferably 0.2 to 2.0 mm. This outer layer corresponds to a layer of what is called the thin concrete milk layer.

According to a seventh preferred embodiment of the invention, the tack mat is formed of an extruded film which is provided with standing mushroom-shaped filaments on one side. The filaments hereby have a thickening at their free ends. The diameter of the filament at the height of the thickening hereby preferably amounts to 1.5 to 2 times the diameter of the filament between the thickening and the base on which the filament stands. This extruded film is fixed to a fabric structure, such as for example a Jersey fabric, such that the standing filaments are turned away from the fabric. According to this embodiment, the extruded film is made of polypropylene and it is welded onto the fabric structure which is made of polypropylene as well.

The filaments have a density of preferably some 200 to 400 filaments per $cm^2$, in particular some 340 filaments per $cm^2$. The filaments preferably have a diameter situated between 0.05 and 0.5 mm, in particular between 0.1 and 0.2 mm.

The total thickness of the tack mat preferably amounts to 0.3 to 1.3 mm, in particular some 0.5 mm. The height of the filaments hereby amounts to 0.1 mm to 1 mm, in particular some 0.2 mm.

When the tack mat has been provided on the concrete element, the fabric with the extruded film fits closely onto this concrete element and the standing filaments extend in the concrete element up to a depth which amounts to 0.1 mm to 1 mm, in particular 0.2 mm.

According to an eighth preferred embodiment of the invention, the tack mat comprises standing filaments which are formed of standing polypropylene hooks The filaments have a density of preferably some 60 to 100 filaments per $cm^2$, in particular some 80 filaments per $cm^2$. The filaments preferably have a diameter situated between 0.05 and 1 mm, in particular between 0.1 and 0.8 mm.

The total thickness of the tack mat preferably amounts to 0.5 to 1.5 mm, in particular some 1.1 mm. The height of the filaments hereby amounts to 0.1 mm to 1 mm, in particular some 0.2 mm.

Said tack mat is anchored in the concrete element up to a depth of 0.1 to 1 mm, preferably some 0.2 mm.

The standing hooks are preferably welded onto a woven base structure which is further fixed on an elastic mat. The standing hooks can also be woven into the woven base structure.

The strength of the connection between the tack mat and the concrete element is determined by several factors, including:

- the surface size of the tack mat;
- to what extent the standing filaments are embedded in the concrete element, in particular the number of embedded filaments and their depth in the concrete element;
- the shape of the standing filaments which are embedded in the concrete element;
- the density of the standing filaments on the surface of the tack mat.

Further, it is of course also important for the standing filaments to be sufficiently firmly fixed to one another via the tack mat. This can be obtained by fixing the standing filaments in a woven structure, for example.

In order to determine the strength of the connection between the tack mat and the concrete element, one can determine a pull-out force. This pull-out force is the force required to pull the tack mat out of the concrete element, such that the elastic sole comes off the concrete element.

With the above-described embodiments of an elastic sole according to the invention, it is possible to obtain a pull-out force of at least 0.6 to 1.0 MPa, up to even at least 1.7 MPa.

Further, it is also important to distribute the tensions in the concrete resulting from the fixing of the elastic sole. Consequently, the standing filaments of the tack mat are preferably distributed homogenously, as a result of which the tension in the concrete element can be well distributed.

The standing filaments are preferably anchored at a very small depth, such that these standing filaments have practically no influence whatsoever on the structure and the strength of the concrete element.

This depth is preferably also very small so that any chippings present in the concrete element have no influence on the anchoring of the tack mat.

Because of the limited depth of the anchoring, it is also possible to embed the tack mat in rather dry concrete and/or in concrete with little liquidity.

When manufacturing the concrete element with the tack mat according to the invention, it is possible to use a vibrating or non-vibrating lid.

The concrete which is poured in a formwork for manufacturing the concrete element can be compacted by means of a vibrating plate.

The invention also concerns a method for installing an elastic sole as described above, whereby this elastic sole is provided on a concrete element while the concrete of this concrete element is still wet and has not cured yet. The tack mat hereby fits closely to the concrete element and the standing filaments penetrate at least partly in the concrete element. After the concrete has dried and cured, the tack mat is at least partly embedded in the concrete element as a result thereof. This provides for an excellent and strong anchoring of the tack mat.

Naturally, the invention is not restricted to the method and device according to the invention as described above. Thus, the different elements of the described embodiments can be combined and, for example, the density and shape of the standing filaments can be adjusted to obtain a desired anchoring strength. Thus, the base via which the filaments are connected to one another and via which the filaments are fixed to the elastic mat may consist of a synthetic foil. This may be a continuous synthetic foil or it may also be provided with recesses. Also a synthetic foil combined with a woven structure may form the base. Further, the filaments may have a thickening and/or recess at their free ends. Further, also the dimensions of the concrete element can be selected as a function of the requirements for a specific application.

The invention claimed is:

1. Method for manufacturing a concrete element intended for rails of a railway to rest on, whereby an elastic sole is provided on the bottom side of this concrete element, the method comprising the steps of:

- manufacturing a tack mat with a woven base and with standing filaments which extend directly from and are fixed to the woven base of the tack mat,
- forming the elastic sole by fixing the base of the tack mat to an elastic mat,
- embedding the standing filaments at least partly in the concrete element by putting the base onto wet concrete of the concrete element, such that the standing filaments penetrate in an outer layer of the concrete element, after which this wet concrete cures and the tack mat is anchored in the concrete element.

2. Method according to claim 1, wherein the standing filaments penetrate in an outer layer of the concrete element up to a depth of maximally 2 mm.

3. Method according to claim 1, wherein the tack mat is manufactured with a base made of a synthetic foil on which the standing filaments are permanently provided.

4. Method according to claim 1, wherein the base is fixed to the elastic mat by welding or gluing the base onto the elastic mat or by at least partly embedding the base in the elastic mat.

5. Elastic sole with a concrete element intended for rails of a railway to rest on, comprising:

a concrete element;

a tack mat and an elastic mat which are fixed to one another to form an elastic sole, wherein the tack mat is formed of a base which includes a woven structure that is fixed to the elastic mat, wherein the tack mat includes standing filaments which extend directly from the woven structure and are permanently connected to one another via the base and which extend into the concrete element so as to fix the elastic sole to the concrete element.

6. Elastic sole with a concrete element according to claim 5, whereby the base is formed of a synthetic foil which is fixed to the elastic mat and on which the standing filaments are permanently connected to one another.

7. Elastic sole with a concrete element according to claim 5, whereby the base is situated between the concrete element and the elastic mat and fits onto the concrete element and the elastic mat, whereby said base extends over practically the entire elastic mat.

8. Elastic sole with a concrete element according to claim 5, whereby the standing filaments extend in the concrete element up to a depth (A) which amounts to maximally 2 mm.

9. Elastic sole with a concrete element according to claim 5, whereby the tack mat contains at least 25 of said standing filaments per $cm^2$.

10. Elastic sole with a concrete element according to claim 5, whereby 10% to 90% of the surface of the tack mat is formed of standing filament.

11. Elastic sole with a concrete element according to claim 5, whereby the standing filaments have a diameter situated between 0.05 and 2.5 mm.

12. Elastic sole with a concrete element according to claim 5, whereby said base and/or standing filaments are made of polyamide, polyester, polypropylene and/or polyethylene.

13. Elastic sole with a concrete element according to claim 5, whereby said standing filaments have the shape of one of the following shapes: a mushroom, a loop and a hook.

14. Elastic sole with a concrete element according to claim 5, whereby said standing filaments have a free end that has a thickening.

15. Elastic sole with a concrete element according to claim 5, whereby said standing filaments are formed of pile thread.

16. Elastic sole according to claim 5, whereby the elastic mat is formed of rubber and/or resin-bound rubber granules.

17. Elastic sole with a concrete element according to claim 5, whereby the tack mat is fixed to the elastic mat as the base is at least partly embedded in the elastic mat or as this base is glued or welded onto the elastic mat.

18. Elastic sole with a concrete element according to claim 5, whereby the base with the standing filaments of the tack mat form a three-dimensionally woven structure.

19. Elastic sole with a concrete element according to claim 18, whereby free ends of the standing filaments are fixed to a woven structure which is embedded in the concrete element.

20. Elastic sole with a concrete element according to claim 5, whereby the elastic sole is anchored with the concrete element and the pull-out force is at least 0.6 to 1.7 MPa.

21. Elastic sole with a concrete element according to claim 5, whereby the standing filaments have a diameter which amounts to maximally 10% of the average diameter of any chippings that are present in the concrete element, and whereby the standing filaments have a length which amounts to maximally 100% of the average diameter of any chippings that are present in the concrete element.

* * * * *